US011191320B2

(12) United States Patent
Happen

(10) Patent No.: US 11,191,320 B2
(45) Date of Patent: Dec. 7, 2021

(54) FOOTWEAR WITH VERTICALLY EXTENDED HEEL COUNTER

(71) Applicant: NIKE, Inc., Beaverton, OR (US)

(72) Inventor: Matthew Happen, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 78 days.

(21) Appl. No.: 16/689,665

(22) Filed: Nov. 20, 2019

(65) Prior Publication Data

US 2020/0205517 A1 Jul. 2, 2020

Related U.S. Application Data

(60) Provisional application No. 62/785,780, filed on Dec. 28, 2018.

(51) Int. Cl.

| | |
|---|---|
| ***A43B 23/08*** | (2006.01) |
| ***A43B 21/24*** | (2006.01) |
| ***A43B 23/17*** | (2006.01) |
| ***A43B 11/00*** | (2006.01) |

(52) U.S. Cl.

CPC ..... *A43B 21/24* (2013.01); *A43B 11/00* (2013.01); *A43B 23/08* (2013.01); *A43B 23/088* (2013.01); *A43B 23/17* (2013.01)

(58) Field of Classification Search

CPC ..... A43B 11/00; A43B 23/08; A43B 23/088
USPC ..... 36/69, 138
See application file for complete search history.

(56) References Cited

U.S. PATENT DOCUMENTS

| | | | |
|---|---|---|---|
| 4,497 | A | 5/1846 | Vetter |
| 75,048 | A | 3/1868 | Perley |
| 91,547 | A | 6/1869 | Leathe |
| 171,301 | A | 12/1875 | McKee |
| 219,436 | A | 9/1879 | Beneke |
| 417,460 | A | 12/1889 | Wurtele |
| 465,189 | A | 12/1891 | Morison |
| 474,574 | A | 5/1892 | Bruzon |
| 503,588 | A | 8/1893 | Elterich et al. |
| 537,627 | A | 4/1895 | Bixby et al. |
| 558,937 | A | 4/1896 | Edmonds |
| 808,948 | A | 1/1906 | Roberts |
| 827,330 | A | 7/1906 | Tillson |
| 863,549 | A | 8/1907 | Metz |
| 882,109 | A | 3/1908 | Harris |

(Continued)

FOREIGN PATENT DOCUMENTS

| | | | |
|---|---|---|---|
| CH | 132884 | A | 5/1929 |
| CN | 87209219 | U | 5/1988 |

(Continued)

OTHER PUBLICATIONS

Aidin H., Under Armour's Innovative Fall/Winter2016 Collection Now Available at All Brand Houses, Aug. 27, 2016, https://www.runsociety.com/news/under-armours-innovative-fallwinter-2016-collection-now-available-at-all-brand-houses/ (accessed Nov. 4, 2017).

(Continued)

*Primary Examiner* — Marie D Bays
(74) *Attorney, Agent, or Firm* — Quinn IP Law

(57) ABSTRACT

An article of footwear has an upper and a heel system. The heel system may include a heel cage secured to a heel portion of the upper, and a heel counter. The heel counter may extend along the rear of the heel portion to an upper extent above the upper bar.

19 Claims, 7 Drawing Sheets

(56) References Cited

U.S. PATENT DOCUMENTS 911,025 A 2/1909 Blaisdell
955,337 A 4/1910 Lawlor
1,028,598 A 6/1912 Papp
1,081,678 A 12/1913 Langerak
1,090,106 A * 3/1914 Montine ..... A43B 23/17 36/69
1,155,354 A 10/1915 Hallock
1,275,895 A 8/1918 Fox
1,494,236 A 5/1924 Greathouse
1,585,049 A 5/1926 Skoglund
1,603,144 A 10/1926 Nichols
1,686,175 A 10/1928 Read
1,793,380 A 2/1931 Stone
1,812,622 A 6/1931 Costello
D98,150 S 1/1936 Drake
2,069,752 A 2/1937 Dorr
2,097,810 A 11/1937 Dawes
RE21,654 E * 12/1940 Disch ..... A43B 23/08 12/146 D
2,252,315 A 8/1941 Doree
2,357,980 A 9/1944 Spiro
2,447,590 A * 8/1948 Meltzer ..... A43B 9/14 36/19.5
2,450,250 A 9/1948 Napton
2,452,502 A 10/1948 Tarbox
2,452,649 A 11/1948 Graves
2,487,227 A 11/1949 Eberle
2,619,744 A 12/1952 Mattes
2,693,039 A 11/1954 Balut
2,736,110 A 2/1956 Hardimon
2,746,178 A 5/1956 Miller et al.
2,825,155 A 3/1958 Hines
2,920,402 A 1/1960 Minera
3,039,207 A 6/1962 Lincors
3,146,535 A * 9/1964 Owings ..... A43B 3/16 36/7.3
3,192,651 A 7/1965 Smith
3,283,423 A 11/1966 Schovee
3,349,505 A 10/1967 Lopez
3,400,474 A 9/1968 Tendler
3,436,842 A 4/1969 Sachs
3,681,860 A 8/1972 Bidegain
4,030,213 A 6/1977 Daswick
4,095,356 A 6/1978 Robran et al.
4,136,468 A 1/1979 Munschy
4,309,832 A 1/1982 Hunt
4,402,146 A * 9/1983 Parracho ..... A43B 5/06 36/129
4,414,761 A 11/1983 Mahood
4,459,765 A * 7/1984 Power ..... A43B 23/17 36/114
4,489,509 A 12/1984 Libit
4,507,879 A 4/1985 Dassler
4,559,724 A 12/1985 Norton
4,562,651 A 1/1986 Frederick et al.
4,566,206 A 1/1986 Weber
4,573,457 A 3/1986 Parks
4,594,798 A 6/1986 Autry et al.
4,599,811 A 7/1986 Rousseau
4,615,126 A 10/1986 Mathews
4,625,435 A * 12/1986 Ueda ..... A43B 23/17 36/114
4,649,656 A 3/1987 Cox et al.
4,665,634 A 5/1987 Diaz
4,776,111 A 10/1988 Crowley
4,944,099 A 7/1990 Davis
4,972,613 A 11/1990 Loveder
5,054,216 A 10/1991 Lin
5,060,401 A 10/1991 Whatley
5,090,140 A 2/1992 Sessa
5,127,170 A 7/1992 Messina
5,152,082 A 10/1992 Culpepper
5,181,331 A 1/1993 Berger
D333,377 S 2/1993 Hatfield
5,184,410 A 2/1993 Hamilton
5,222,313 A 6/1993 Dowdy et al.
5,279,051 A 1/1994 Whatley
5,282,327 A 2/1994 Ogle
5,317,819 A 6/1994 Ellis, III
5,341,583 A 8/1994 Hallenbeck
5,371,957 A 12/1994 Gaudio
5,467,537 A 11/1995 Aveni et al.
5,481,814 A 1/1996 Spencer
5,557,866 A 9/1996 Prengler
5,570,523 A 11/1996 Lin
5,682,687 A 11/1997 Arai
5,787,608 A * 8/1998 Greenawalt ..... A43B 3/128 36/11.5
5,813,144 A 9/1998 Prengler
5,826,353 A 10/1998 Woznicki
5,842,292 A 12/1998 Siesel
D404,896 S 2/1999 Cooper
5,884,420 A 3/1999 Donnadieu
6,000,148 A * 12/1999 Cretinon ..... A43B 5/00 36/69
6,189,239 B1 2/2001 Gasparovic et al.
6,298,582 B1 10/2001 Friton et al.
6,314,662 B1 11/2001 Ellis, III
6,360,454 B1 3/2002 Dachgruber et al.
6,378,230 B1 4/2002 Rotem et al.
6,438,872 B1 8/2002 Chil et al.
6,497,058 B2 12/2002 Dietrich et al.
6,557,271 B1 5/2003 Weaver, III
6,578,288 B2 6/2003 Bernstein
6,594,921 B2 7/2003 Laio et al.
6,643,954 B2 11/2003 Voswinkel
6,684,533 B1 2/2004 Su
6,718,658 B2 4/2004 Karasawa
6,817,116 B2 11/2004 Chil et al.
6,883,254 B2 4/2005 Miller et al.
6,925,732 B1 * 8/2005 Clarke ..... A43B 7/141 36/27
6,938,361 B2 9/2005 Su
6,957,504 B2 10/2005 Morris
6,964,119 B2 11/2005 Weaver, III
7,055,268 B2 6/2006 Ha
7,059,069 B2 6/2006 Raluy et al.
7,080,468 B2 7/2006 Miller et al.
7,082,702 B2 8/2006 Cretinon
7,101,604 B1 9/2006 Minges
7,103,994 B2 9/2006 Johnson
7,127,837 B2 10/2006 Ito
7,168,188 B2 1/2007 Auger et al.
7,168,190 B1 1/2007 Gillespie
7,178,270 B2 2/2007 Hurd et al.
7,188,438 B1 3/2007 Bowen
7,225,563 B2 6/2007 Chen et al.
7,284,341 B2 10/2007 Moseley
7,287,294 B2 10/2007 Miller et al.
7,392,603 B1 7/2008 Shepherd et al.
7,439,837 B2 10/2008 McDonald
7,448,148 B2 11/2008 Martinez et al.
7,472,495 B2 1/2009 Milbourn
7,526,881 B2 5/2009 Jones et al.
7,581,337 B2 9/2009 Miller et al.
7,607,242 B2 10/2009 Karandonis et al.
7,685,747 B1 3/2010 Gasparovic et al.
7,694,435 B1 4/2010 Kiser et al.
7,735,244 B1 6/2010 Ameche
7,793,438 B1 9/2010 Busse et al.
7,810,257 B2 10/2010 Candrian et al.
7,823,299 B1 11/2010 Brigham
7,900,377 B1 3/2011 Perenich
7,905,033 B1 3/2011 Perenich
7,913,422 B1 3/2011 Perenich
7,950,166 B1 5/2011 Perenich
7,975,403 B2 7/2011 Mosher
8,006,410 B2 8/2011 Romboli et al.
8,020,317 B1 9/2011 Sokolowski
D648,512 S 11/2011 Schlageter et al.
8,056,264 B2 11/2011 Sato et al.
8,061,059 B2 11/2011 Bruce et al.
8,065,819 B2 11/2011 Kaufman

(56) References Cited

U.S. PATENT DOCUMENTS 8,161,669 B2 4/2012 Keating
8,171,657 B1 5/2012 Perenich
8,215,030 B2 7/2012 Bowen et al.
8,225,534 B2 7/2012 Mueller et al.
8,225,535 B2 7/2012 Dillenbeck
8,245,418 B2 8/2012 Paintin et al.
8,245,421 B2 8/2012 Baudouin et al.
8,256,146 B2 9/2012 Loverin
8,365,443 B2 2/2013 Huynh
8,468,721 B2 6/2013 Sokolowski
8,468,723 B2 6/2013 Malka-Harari
8,499,474 B2 8/2013 Kaufman
8,539,698 B1 9/2013 Woodruff
8,549,774 B2 10/2013 Meschter et al.
8,627,582 B2 1/2014 Perenich
8,627,583 B2 1/2014 Perenich
8,635,791 B2 1/2014 Baudouin et al.
8,677,656 B2 3/2014 Nishiwaki et al.
8,745,893 B2 6/2014 Gavrieli et al.
8,763,275 B2 7/2014 Shalom et al.
8,769,845 B2 7/2014 Lin
8,834,770 B2 9/2014 Nakano
8,919,015 B2 12/2014 Holt et al.
9,015,962 B2 4/2015 Boudreau et al.
9,032,646 B2 5/2015 Perenich
9,061,096 B2 6/2015 Taylor et al.
9,089,184 B1 7/2015 Kiser et al.
9,095,188 B2 8/2015 Cavaliere
9,119,436 B1 9/2015 Ardell et al.
9,119,437 B2 9/2015 Weller et al.
9,144,262 B2 9/2015 Ardell et al.
9,173,451 B2 11/2015 Shim
9,226,543 B2 1/2016 Campbell
9,254,018 B2 2/2016 Bliss
9,265,305 B2 2/2016 Hatfield et al.
9,301,570 B2 4/2016 Hwang
9,314,055 B2 4/2016 Moran
9,392,843 B2 7/2016 Callahan et al.
9,398,785 B2 7/2016 Horacek
9,398,786 B2 7/2016 Gavrieli et al.
9,414,640 B2 8/2016 Nichols
9,433,256 B2 9/2016 Callahan et al.
9,480,299 B2 11/2016 Dinndorf et al.
D776,420 S 1/2017 Petrie
D781,561 S 3/2017 Gibson
9,675,132 B2 6/2017 Marshall
9,820,527 B2 11/2017 Pratt et al.
9,867,426 B2 1/2018 Conant et al.
9,877,542 B2 1/2018 Pratt
D853,707 S * 7/2019 Flanagan ..... A43B 11/00 D2/972
D854,303 S 7/2019 Flanagan et al.
10,455,898 B1 10/2019 Orand et al.
10,617,174 B1 4/2020 Hopkins et al.
10,638,810 B1 5/2020 Cheney et al.
10,653,209 B2 5/2020 Pratt et al.
10,660,401 B1 5/2020 Pratt et al.
10,905,192 B1 2/2021 Cheney
2002/0112376 A1 8/2002 Tomat
2002/0144434 A1 10/2002 Farys et al.
2002/0174568 A1 11/2002 Neiley
2004/0111921 A1 6/2004 Lenormand
2005/0039348 A1 2/2005 Raluy et al.
2005/0060913 A1 3/2005 Chil et al.
2005/0066548 A1 3/2005 Chil et al.
2005/0193594 A1* 9/2005 Murphy ..... A43B 5/1616 36/89
2006/0032091 A1 2/2006 Kilgore
2007/0011917 A1 1/2007 Hayes
2007/0039208 A1 2/2007 Bove et al.
2007/0074425 A1 4/2007 Leong
2007/0186441 A1 8/2007 Chen
2007/0199211 A1 8/2007 Campbell
2007/0199213 A1 8/2007 Campbell et al.
2007/0256332 A1 11/2007 Calderone
2008/0000106 A1 1/2008 Culpepper
2008/0083138 A1 4/2008 Lacorazza et al.
2008/0086911 A1 4/2008 Labbe
2008/0120871 A1 5/2008 Sato et al.
2008/0141562 A1 6/2008 Peveto
2008/0155788 A1 7/2008 Wilcox
2008/0307673 A1 12/2008 Johnson
2009/0025260 A1 1/2009 Nakano
2009/0113757 A1* 5/2009 Banik ..... A43B 13/26 36/28
2010/0319216 A1 12/2010 Grenzke et al.
2011/0016751 A1 1/2011 Somerville
2011/0119959 A1 5/2011 Bodner
2011/0146106 A1 6/2011 Kaufman
2011/0185592 A1* 8/2011 Nishiwaki ..... A43B 7/16 36/69
2011/0214312 A1 9/2011 Krikelis
2012/0079742 A1 4/2012 Ferreira et al.
2012/0079746 A1 4/2012 Ferreira et al.
2012/0180338 A1 7/2012 Lin
2012/0192453 A1 8/2012 Raysse et al.
2012/0304491 A1 12/2012 Kimura et al.
2012/0317839 A1 12/2012 Pratt
2013/0185959 A1 7/2013 Coleman
2013/0219747 A1 8/2013 Lederer
2014/0013624 A1 1/2014 Stockbridge et al.
2014/0096415 A1 4/2014 Long
2014/0115925 A1 5/2014 Hurd et al.
2014/0173935 A1 6/2014 Sabbioni
2014/0202044 A1 7/2014 Adami et al.
2014/0250723 A1 9/2014 Kohatsu
2014/0298687 A1 10/2014 Flinterman et al.
2014/0305005 A1 10/2014 Yeh
2014/0310992 A1 10/2014 Shalom et al.
2014/0360049 A1 12/2014 Panian et al.
2015/0047227 A1 2/2015 Fallon et al.
2015/0113834 A1 4/2015 Dojan et al.
2015/0143720 A1 5/2015 Avar
2015/0196095 A1 7/2015 Chapman
2015/0216252 A1 8/2015 Wiens
2015/0289595 A1 10/2015 Rushbrook et al.
2015/0305432 A1 10/2015 Wiens
2016/0120259 A1 5/2016 Benetti
2016/0128429 A1 5/2016 Hatfield et al.
2016/0302530 A1 10/2016 Smith et al.
2016/0374427 A1 12/2016 Zahabian
2017/0150773 A1 6/2017 Beers
2017/0265560 A1 9/2017 Beers et al.
2017/0303632 A1 10/2017 Pratt et al.
2017/0360143 A1 12/2017 Pratt et al.
2018/0098601 A1 4/2018 Hartenstein et al.
2018/0110287 A1 4/2018 Hopkins et al.
2018/0110288 A1 4/2018 Hatfield et al.
2018/0110289 A1 4/2018 Owings et al.
2018/0110292 A1* 4/2018 Beers ..... A43B 23/08
2018/0206588 A1 7/2018 Pratt et al.
2018/0235314 A1 8/2018 Farage
2018/0289109 A1* 10/2018 Beers ..... A43B 21/26
2018/0295942 A1 10/2018 Drake
2018/0338583 A1 11/2018 Sullivan
2019/0000186 A1 1/2019 Mou et al.
2019/0297999 A1* 10/2019 Nakaya ..... A43B 13/41
2020/0000178 A1 1/2020 Pratt et al.
2020/0196703 A1 6/2020 Hopkins
2020/0205511 A1 7/2020 Hopkins et al.
2020/0205518 A1 7/2020 Hopkins et al.
2020/0205520 A1 7/2020 Kilgore
2020/0305552 A1 10/2020 Cheney et al.
2021/0030107 A1 2/2021 Pratt et al.
2021/0068498 A1 3/2021 Cheney et al.
2021/0112911 A1 4/2021 Pratt et al.
2021/0112914 A1 4/2021 Cheney
2021/0112916 A1 4/2021 Schulten

FOREIGN PATENT DOCUMENTS

CN 87103983 A 12/1988
CN 2052208 U 2/1990
CN 2438353 Y 7/2001

(56) References Cited

FOREIGN PATENT DOCUMENTS

| | | | |
|---|---|---|---|
| CN | 1403041 | A | 3/2003 |
| CN | 1278639 | C | 10/2006 |
| CN | 1943463 | A | 4/2007 |
| CN | 2901950 | Y | 5/2007 |
| CN | 201005111 | Y | 1/2008 |
| CN | 101485505 | A | 7/2009 |
| CN | 201426430 | Y | 3/2010 |
| CN | 201743039 | U | 2/2011 |
| CN | 201831038 | U | 5/2011 |
| CN | 101991227 | B | 8/2012 |
| CN | 102770039 | A | 11/2012 |
| CN | 203841187 | U | 9/2014 |
| CN | 203986373 | U | 12/2014 |
| CN | 104394729 | A | 3/2015 |
| CN | 102595952 | B | 4/2015 |
| CN | 105476180 | A | 4/2016 |
| CN | 205568021 | U | 9/2016 |
| CN | 206025369 | U | 3/2017 |
| CN | 207544444 | U | 6/2018 |
| DE | 3310988 | A1 | 9/1984 |
| DE | 3928625 | A1 | 3/1991 |
| DE | 19534249 | A1 | 3/1997 |
| DE | 19611797 | A1 | 10/1997 |
| DE | 29809404 | U1 | 8/1998 |
| DE | 10247163 | A1 | 4/2004 |
| DE | 102004005288 | A1 | 8/2005 |
| DE | 102013200701 | A1 | 7/2013 |
| EP | 0149362 | A2 | 7/1985 |
| EP | 0570621 | A1 | 11/1993 |
| EP | 1059044 | A1 | 12/2000 |
| EP | 1952715 | A1 | 8/2008 |
| EP | 2204102 | A1 | 7/2010 |
| EP | 2277402 | A2 | 1/2011 |
| EP | 2490565 | A1 | 8/2012 |
| EP | 2818068 | A1 | 12/2014 |
| EP | 2848141 | A1 | 3/2015 |
| EP | 3167742 | A1 | 5/2017 |
| FR | 1083503 | A | 1/1955 |
| FR | 2994800 | A1 | 3/2014 |
| GB | 503525 | A | 4/1939 |
| GB | 603525 | A | 6/1948 |
| GB | 1154145 | A | 6/1969 |
| GB | 1358470 | A | 7/1974 |
| GB | 2517148 | A | 2/2015 |
| GB | 2517399 | A | 2/2015 |
| GB | 2533809 | A | 7/2016 |
| JP | H0181910 | U | 6/1989 |
| JP | 2001149394 | A | 6/2001 |
| JP | 2002262907 | A | 9/2002 |
| JP | 2004236860 | A | 8/2004 |
| JP | 2005532115 | A | 10/2005 |
| JP | 2006055571 | A | 3/2006 |
| JP | 2008206629 | A | 9/2008 |
| JP | 2012061046 | A | 3/2012 |
| KR | 20090130804 | A | 12/2009 |
| KR | 101841085 | B1 | 3/2018 |
| TW | 200930315 | A | 7/2009 |
| TW | I581730 | B | 5/2017 |
| WO | 8808678 | A1 | 11/1988 |
| WO | 03039283 | A1 | 5/2003 |
| WO | 2006084185 | A1 | 8/2006 |
| WO | 2007024875 | A2 | 3/2007 |
| WO | 2007080205 | A1 | 7/2007 |
| WO | 2008115743 | A1 | 9/2008 |
| WO | 2009154350 | A1 | 12/2009 |
| WO | 2010059716 | A2 | 5/2010 |
| WO | 2010114993 | A1 | 10/2010 |
| WO | 2011004946 | A1 | 1/2011 |
| WO | 2012044974 | A1 | 4/2012 |
| WO | 2012168956 | A1 | 12/2012 |
| WO | 2013187288 | A1 | 12/2013 |
| WO | 2014033396 | A1 | 3/2014 |
| WO | 2014140443 | A1 | 9/2014 |
| WO | 2015002521 | A1 | 1/2015 |
| WO | 2015183486 | A1 | 12/2015 |
| WO | 2016002412 | A1 | 1/2016 |
| WO | 2016005696 | A1 | 1/2016 |
| WO | 2016015161 | A1 | 2/2016 |
| WO | 2017184943 | A1 | 10/2017 |
| WO | 2020006490 | A1 | 1/2020 |
| WO | 2020146113 | A1 | 7/2020 |
| WO | 2020146176 | A1 | 7/2020 |
| WO | 2020176653 | A1 | 9/2020 |
| WO | 2021021917 | A1 | 2/2021 |
| WO | 2021045902 | A1 | 3/2021 |
| WO | 2021050536 | A1 | 3/2021 |

OTHER PUBLICATIONS

Nike Ease Challenge Winner Announced, Nike News, Apr. 25, 2017, https://news.nike.com/news/nike-ease-challenge-winner-announced (accessed May 2, 2018).
U.S. Appl. No. 61/260,621, filed Nov. 12, 2009.
U.S. Appl. No. 62/368,497, filed Jul. 29, 2016.
Kizik Design, Kizik® Shoes Launch Footwear Revolution with Patented Handsfiee Technology, https://www.prnewswire.com/news-releases/kizik-shoes-launch-footwear-revolution-with-patented-handsfree-technology-300594838.html, Feb. 7, 2018.
U.S. Appl. No. 62/326,650, filed Apr. 22, 2016.
Anonymous, "RIVETS Two Piece Snap Rivets ITW Fastex", Jan. 30, 2008, XP55669700, Retrieved from the Internet: URL: http://www.itw-fastex.com/catalog/index.php/dw/op/a/6/c/14/p/27?m=no#specs.
U.S. Appl. No. 62/966,499, filed Jan. 27, 2020.
U.S. Appl. No. 62/937,107, filed Nov. 18, 2019.
U.S. Appl. No. 62/935,556, filed Nov. 14, 2019.
U.S. Appl. No. 62/897,881, filed Sep. 9, 2019.
U.S. Appl. No. 62/895,330, filed Sep. 3, 2019.
U.S. Appl. No. 62/879,883, filed Jul. 29, 2019.
U.S. Appl. No. 62/810,828, filed Feb. 26, 2019.
U.S. Appl. No. 62/789,395, filed Jan. 7, 2019.
U.S. Appl. No. 62/789,367, filed Jan. 7, 2019.
U.S. Appl. No. 62/755,123, filed Nov. 2, 2018.
U.S. Appl. No. 62/691,201, filed Jun. 28, 2018.

* cited by examiner

FOOTWEAR WITH VERTICALLY EXTENDED HEEL COUNTER

CROSS-REFERENCE TO RELATED APPLICATION

This application claims the benefit of priority to U.S. Provisional Application No. 62/785,780, filed Dec. 28, 2018, which is hereby incorporated by reference in its entirety.

TECHNICAL FIELD

The present disclosure generally relates to an article of footwear that includes a heel system with a heel cage and a heel counter.

BACKGROUND

An article of footwear typically includes a sole structure configured to be located under a wearer's foot to space the foot away from the ground. Sole structures in athletic footwear are typically configured to provide cushioning, motion control, and/or resilience. Traditionally, placing footwear on a foot often requires the use of one or both hands to stretch the ankle opening of a footwear upper, and hold the rear portion during foot insertion, especially in the case of a relatively soft upper and/or an upper that does not have a heel counter.

BRIEF DESCRIPTION OF THE DRAWINGS

The drawings described herein are for illustrative purposes only, are schematic in nature, and are intended to be exemplary rather than to limit the scope of the disclosure.

DESCRIPTION

Figure 1:
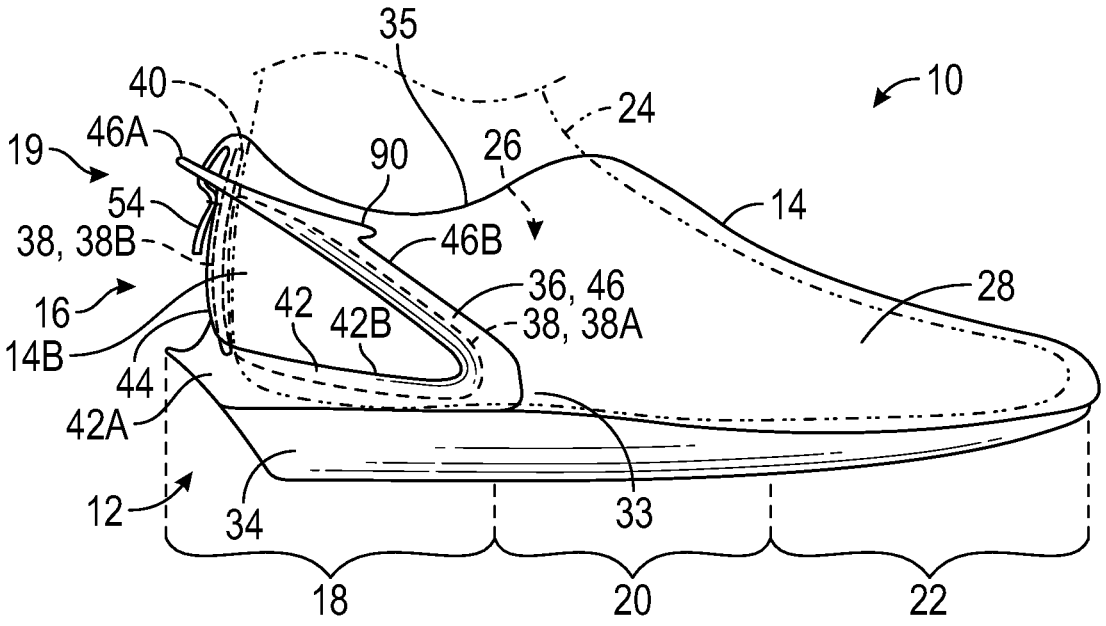
FIG. 1 is a lateral side view of an article of footwear having an upper and a heel system that includes a heel cage and a heel counter, and with a foot in phantom fragmentary view.

The present disclosure generally relates to an article of footwear that includes a heel system configured to enable easy foot entry without collapse of the rear of the upper, effectively shoe-horning the foot into the upper. More specifically, in an example, the article of footwear may comprise an upper having a heel portion and a heel system. The heel system may include a heel cage secured to the upper, and a heel counter. The heel counter may extend along the rear of the heel portion to an upper extent above the heel cage.

In some configurations, the heel cage may have a base and an upper bar. The base may extend around a rear of the heel portion from a medial side to a lateral side of the upper, and the upper bar may extend around the rear of the heel portion above the base. The upper bar may be connected to a forward medial portion of the base and to a forward lateral portion of the base, and may be spaced apart from the base at the rear of the heel portion.

The heel counter may be relatively more rigid than the upper. By extending to an upper extent above the upper bar, the heel counter may inhibit collapse of the upper, and hence the heel cage, during foot entry. Additionally, the upper may extend over and cover the upper extent of the heel counter. An exterior surface of the upper disposed over the upper extent of the heel counter may have a coefficient of friction less than or equal to a predetermined coefficient of friction selected to allow easy gliding of the foot into a foot-receiving cavity of the upper. For example, the upper may comprise leather at the exterior surface disposed over the upper extent of the heel counter.

In one or more implementations, the upper may be operatively secured to a center segment of the upper bar. The center segment of the upper bar may define a slot, and the upper may include a tab that extends through the slot. The tab may be secured to an exterior surface of the upper at the rear of the heel portion of the upper. By securing the upper to the center segment of the upper bar via the slot and tab, the resistance to compression during foot entry provided by the relatively stiff heel counter may also inhibit collapse of the upper bar toward the base.

In an aspect, the heel counter may include a first layer and a second layer. The second layer may be relatively more rigid than the first layer and may be taller than the first layer, establishing the upper extent of the heel counter. The second layer may be thicker than the first layer, or may be both taller and thicker than the first layer. For example, the second layer may be at least twice as thick as the first layer. Reinforcement to inhibit collapse of the footwear in the heel region may be achieved at the rear of the heel portion by focusing the relatively stiff second layer at the rear of the heel portion, with the less stiff first layer extending further around the rear of the heel portion from the medial side to the lateral side than the second layer. With the second layer thus less wide in the transverse direction of the article of footwear than the first layer, overall weight and materials reduction may be achieved.

In another aspect, the heel counter may be disposed inward of an exterior layer of the upper. For example, the heel counter may be disposed between the exterior layer of the upper and an interior layer of the upper. The heel cage may be disposed exterior to an exterior surface of the exterior layer of the upper. In such an implementation, the heel cage may be exposed at the exterior of the article of footwear, while the heel counter is hidden from view between the exterior layer and the interior layer of the upper.

Various materials may be used to achieve the purposes of the article of footwear having the heel system functioning as described. In non-limiting examples, the heel counter may comprise a thermoplastic compressed powder, the heel cage may comprise a thermoplastic poly(ether) block copolymer elastomer, and/or the exterior surface of the upper disposed over the upper extent may comprise natural or synthetic leather, and in one implementation may be a natural full-grain leather.

In an example, an article of footwear may comprise an upper having a heel portion and defining a foot-receiving cavity and an ankle opening communicating with the foot-receiving cavity. The article of footwear may also comprise a heel system that includes a heel cage and a heel counter. The heel cage may have a base and an upper bar. The base may extend around a rear of the heel portion from a medial side to a lateral side of the upper. The upper bar may extend around the rear of the heel portion above the base and may be connected to a forward medial portion of the base and to a forward lateral portion of the base. The upper bar may be spaced apart from the base at the rear of the heel portion and the heel cage may surround the rear of the foot-receiving cavity below the ankle opening. The heel counter may extend along the rear of the heel portion to an upper extent above the upper bar. The upper may extend over the upper extent of the heel counter and may have an exterior surface exposed over the upper extent of the heel counter and extending inward into the foot-receiving cavity from the ankle opening. The heel counter may have at least a predetermined rigidity and the exterior surface of the upper may be exposed over the upper extent of the heel counter. The exterior surface of the upper may have a coefficient of friction less than or equal to a predetermined coefficient of friction. The predetermined rigidity of the heel counter and the coefficient of friction of the exterior surface of the upper exposed over the upper extent of the heel counter may enable a foot to slide into the foot-receiving cavity without deformation of the heel cage when the foot exerts a predetermined force on the exterior surface of the upper exposed over the upper extent of the heel counter.

In an example, an article of footwear may comprise an upper having a heel portion and defining a foot-receiving cavity and an ankle opening communicating with the foot-receiving cavity. The article of footwear may include a heel system including a heel counter extending along the heel portion to an upper extent. The upper may be relatively thick over the upper extent of the heel counter. For example, the upper may be thicker than the heel counter at the upper extent. The upper may have an exterior surface exposed over the upper extent of the heel counter and extending inward into the foot-receiving cavity from the ankle opening. The heel counter may have at least a predetermined rigidity and the exterior surface of the upper exposed over the upper extent of the heel counter may have a coefficient of friction less than or equal to a predetermined coefficient of friction. The relatively thick portion of the upper above the upper extent of the heel counter may spread the force exerted by the bottom of a foot over a larger surface area than would a thinner upper at this location, which may make the contact of the upper with the foot more comfortable. The relatively low coefficient of friction helps to counter the drag effect of the larger surface area in contact with the foot, making it easier for the foot to slide.

The above features and advantages and other features and advantages of the present teachings are readily apparent from the following detailed description of the modes for carrying out the present teachings when taken in connection with the accompanying drawings.

Referring to the drawings, wherein like reference numbers refer to like components throughout the views, FIG. 1 shows an article of footwear 10 with a sole structure 12 and a footwear upper 14, and including a heel system 16 that inhibits collapse of the footwear 10 in the heel region 18, among other features and advantages. The footwear 10 herein is depicted as a leisure shoe or an athletic shoe, but the present teachings also include an article of footwear that is a dress shoe, a work shoe, a sandal, a slipper, a boot, or any other category of footwear.

Figure 2:
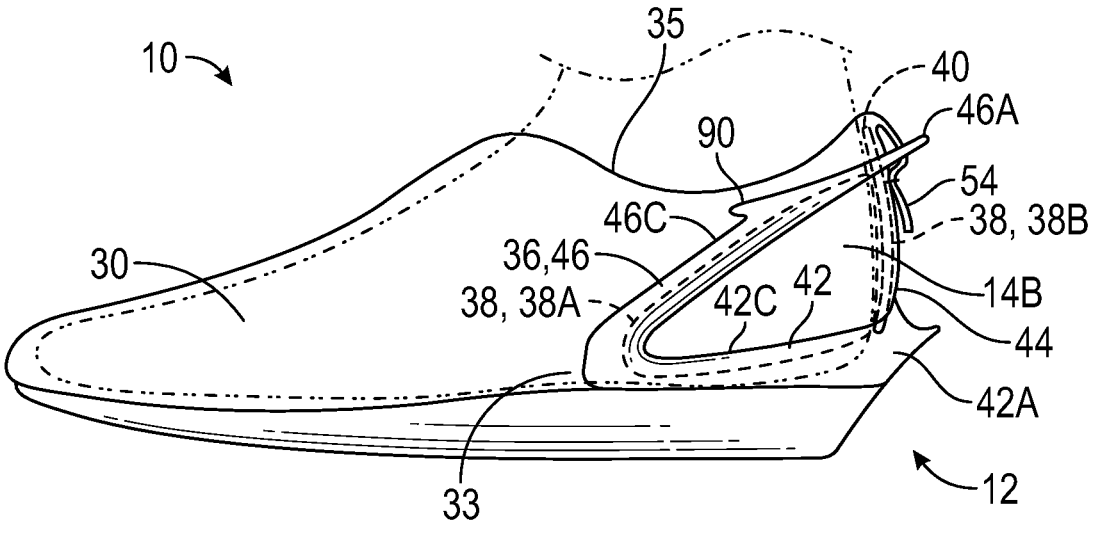
FIG. 2 is a medial side view of the article of footwear of FIG. 1 with the foot in phantom fragmentary view.

The article of footwear 10 has the heel region 18, as well as a midfoot region 20 and a forefoot region 22. The heel region 18 generally includes portions of the article of footwear 10 corresponding with rear portions of a human foot 24 (shown in phantom), including the calcaneus bone, when the human foot 24 of a size corresponding with the article of footwear 10 is disposed in a foot-receiving cavity 26 defined by the upper 14, and is supported on the sole structure 12. For example a heel portion 19 of the upper 14 is in the heel region 18. The forefoot region 22 of the article of footwear 10 generally includes portions of the article of footwear 10 corresponding with the toes and the joints connecting the metatarsals with the phalanges of the human foot 24 (interchangeably referred to herein as the "metatarsal-phalangeal joints" or "MPJ" joints). The midfoot region 20 of the article of footwear 10 is disposed between the heel region 18 and the forefoot region 22 and generally includes portions of the article of footwear 10 corresponding with an arch area of the human foot 24, including the navicular joint. FIG. 1 shows a lateral side 28 of the footwear 10, and FIG. 2 shows a medial side 30 of the footwear 10. The lateral side 28 and the medial side 30 both extend from the heel region 18 to the forefoot region 22, and are generally opposite sides of the footwear 10 (e.g., falling on opposite sides of a longitudinal midline of the footwear 10).

The sole structure 12 includes one or more sole components that may be sole layers 34, such as an outsole, a midsole, or a unitary combination of an outsole and a midsole that may be referred to as a unisole. The sole structure 12 underlies the upper 14. A lower portion 33 of the upper 14 may be secured to the sole structure 12, such as by adhesive or otherwise. The sole structure 12 may comprise, for example, a sole layer 34 such as a midsole of an elastomeric foam such as a polyurethane or ethylvinylacetate foam to attenuate ground reaction forces (e.g., provide cushioning) when compressed between the foot and the ground during walking, running, or other ambulatory activities. In further configurations, the sole structure 12 may incorporate fluid-filled chambers, plates, moderators, or other elements in the midsole that further attenuate forces, enhance stability, or influence the motions of the foot. In the embodiment shown, the sole layer 34 may be at least partially a polyurethane foam, a polyurethane ethylene-vinyl acetate (EVA) foam, and may include heat-expanded and molded EVA foam pellets. The sole layer 34 may generally include phylon (ethylene vinyl acetate or "EVA") and/or polyurethane ("PU") base resins. If EVA is used, it may have a vinyl acetate (VA) level between approximately 9% and approximately 40%. Suitable EVA resins include Elvax®, provided by E. I. du Pont de Nemours and Company, and Engage™, provided by the Dow Chemical Company, for example. In certain embodiments, the EVA may be formed of a combination of high melt index and low melt index material. For example, the EVA may have a melt index of from about 1 to about 50. The EVA resin may be compounded to include various components including a blowing agent and a curing/crosslinking agent. The blowing agent may have a percent weight between approximately 10% and approximately 20%. The blowing agent may be thermally decomposable and is selected from ordinary organic and inorganic chemical blowing agents. The nature of the blowing agent is not particularly limited as long as it decomposes under the temperature conditions used in incorporating the foam into the virgin resin. Suitable blowing agents include azodicarboamide, for example. In certain embodiments, a peroxide-based curing agent, such as dicumyl peroxide may be used. The amount of curing agent may be between approximately 0.6% and approximately 1.5%. The EVA may also include homogenizing agents, process aids, and waxes. For example, a mixture of light aliphatic hydrocarbons such as Struktol® 60NS, available from Schill+Seilacher "Struktol" GmbH, may be included to permit other materials or scrap EVA to be more easily incorporated into the resin. The EVA may also include other constituents such as a release agent (e.g., stearic acid), activators (e.g., zinc oxide), fillers (e.g., magnesium carbonate), pigments, and clays. In embodiments that incorporate multiple materials, each material may be formed from a material that is compatible and readily bonds with the other material. For example, the materials may each be formed from an EVA resin with suitable blowing agents, crosslinking agents, and other ancillary components, pigments, fillers, and the like. Other suitable materials will become readily apparent to those skilled in the art, given the benefit of this disclosure.

The sole layer 34 may comprise one or more bladder elements that may be blow-molded or formed from polymeric sheets that may comprise a variety of materials including various polymers that can resiliently retain a fluid such as air or another gas. Examples of polymer materials for the polymeric sheets include thermoplastic urethane, polyurethane, polyester, polyester polyurethane, and polyether polyurethane. Moreover, the polymeric sheets can each be formed of layers of different materials. In one embodiment, each polymeric sheet is formed from thin films having one or more thermoplastic polyurethane layers with one or more barrier layers of a copolymer of ethylene and vinyl alcohol (EVOH) that is impermeable to the pressurized fluid contained therein as disclosed in U.S. Pat. No. 6,082,025, which is incorporated by reference in its entirety. Each polymeric sheet may also be formed from a material that includes alternating layers of thermoplastic polyurethane and ethylene-vinyl alcohol copolymer, as disclosed in U.S. Pat. Nos. 5,713,141 and 5,952,065 to Mitchell et al. which are incorporated by reference in their entireties. Alternatively, the layers may include ethylene-vinyl alcohol copolymer, thermoplastic polyurethane, and a regrind material of the ethylene-vinyl alcohol copolymer and thermoplastic polyurethane. The polymeric sheets may also each be a flexible microlayer membrane that includes alternating layers of a gas barrier material and an elastomeric material, as disclosed in U.S. Pat. Nos. 6,082,025 and 6,127,026 to Bonk et al. which are incorporated by reference in their entireties. Additional suitable materials for the polymeric sheets are disclosed in U.S. Pat. Nos. 4,183,156 and 4,219,945 to Rudy which are incorporated by reference in their entireties. Further suitable materials for the polymeric sheets include thermoplastic films containing a crystalline material, as disclosed in U.S. Pat. Nos. 4,936,029 and 5,042,176 to Rudy, and polyurethane including a polyester polyol, as disclosed in U.S. Pat. Nos. 6,013,340, 6,203,868, and 6,321,465 to Bonk et al. which are incorporated by reference in their entireties. In selecting materials for the polymeric sheets, engineering properties such as tensile strength, stretch properties, fatigue characteristics, dynamic modulus, and loss tangent can be considered. The thicknesses of polymeric sheets can be selected to provide these characteristics.

The sole structure 12 may include an outsole or outsole portions that may be formed from materials that may generally include natural or synthetic rubber or other suitably durable materials. The material or materials for the outsole may be selected to provide a desirable combination of durability and flexibility. Synthetic rubbers that may be used include ethylene propylene rubber (EPR), styrene isoprene styrene (SIS) copolymer rubber, and styrene butadiene rubber.

The upper 14 defines at least a portion of an ankle opening 35 that is in communication with the foot-receiving cavity 26. The foot 24 enters into the foot-receiving cavity 26 through the ankle opening 35. The upper 14 may include one or more layers of one or more materials and serves as a covering for receiving and at least partially covering the foot 24 and maintaining the foot 24 in position on the sole structure 12. For example, the upper 14 may include a variety of materials such as textiles, composites, knitted, braided, or woven layers. In one example, the upper 14 may include a stretchable fabric, such as a 4-way stretch nylon fabric, lending a light, breathable feel.

In the embodiment shown, the heel system 16 includes a heel cage 36 and a heel counter 38. The heel counter 38 extends to an upper extent 40 above the heel cage 36 at the heel portion 19 of the upper 14 (e.g., in the heel region 18), and so may be referred to as a vertically-extended heel counter. The heel counter 38 is relatively more rigid than the heel portion 19 of the upper 14 in the heel region 18. The heel counter 38 is sufficiently rigid to inhibit collapse of the footwear 10 at the heel region 18 during foot entry into the foot-receiving cavity 26 at the ankle opening 35 when up to a predetermined force in the vertically downward direction is exerted on the upper 14 and the upper extent 40 of the heel counter 38 as discussed herein.

The heel cage 36 has a base 42 that extends around a rear 44 of the upper 14 from the lateral side 28 to the medial side 30 as shown by FIGS. 1 and 2. The heel cage 36 also includes an upper bar 46 that extends around the rear 44 of the heel portion 19 above the base 42. The heel cage 36 may be a single, unitary, one-piece component that includes the base 42 and the upper bar 46, or may include separate components connected to one another. For example, the heel cage 36 may be injection molded or otherwise formed so that the base 42 and upper bar 46 are portions of the one-piece heel cage 36.

The upper bar 46 includes a center segment 46A, a lateral side arm 46B extending downwardly and forwardly along the lateral side 28 of the upper 14 from the center segment 46A as shown in FIG. 1, and a medial side arm 46C, shown in FIG. 2, spaced from the lateral side arm 46B and extending downwardly and forwardly from the center segment 46A along the medial side 30 of the upper 14.

In one or more embodiments, such as is in the embodiment shown, the base 42 is continuous, and is connected to both the lateral side arm 46B and the medial side arm 46C. The base 42 is continuous and is connected to both a forward portion of the lateral side arm 46B and a forward portion of the medial side arm 46C and extends rearwardly therefrom under the upper bar 46 around the rear 44 of the upper 14. The base 42 is continuous in that it is without breaks or connections through other components in extending from the lateral side arm 46B to the medial side arm 46C. More specifically, the base 42 has a lateral base arm 42B connected to the lateral side arm 46B of the upper bar 46, a medial base arm 42C connected to the medial side arm 46C of the upper bar 46, and a center segment 42A connecting the lateral base arm 42B to the medial base arm 42C. In the example shown, the upper bar 46 has an arced shape, and the continuous base 42 has an arced shape. The upper bar 46 and the base 42 are not limited to the arced shapes shown, and may have other shapes within the scope of the disclosure.

Other than where the lateral side arm 46B of the upper bar 46 is connected to the lateral base arm 42B and where the medial side arm 46C of the upper bar 46 is connected to the medial base arm 42C, the upper bar 46 is spaced apart from the base 42. The upper 14 is exposed at the exterior of the footwear 10 between the upper bar 46 and the base 42. For example, the exterior layer 14B of the upper 14 is exposed. In other embodiments, the heel cage 36 need not include a base 42, and ends of the lateral side arm 46B and the medial side arm 46C opposite from the center segment 46A may be anchored to the sole structure 12 and/or to the upper 14.

The base 42 may be secured to the sole layer 34 such as by bonding with adhesive, thermal bonding, or otherwise. Additionally or alternatively, the base 42 may be secured to the lower portion 33 of the upper 14. The upper bar 46 is also secured to the upper 14 as the center segment 46A is operatively connected to the upper 14 rearward of the ankle opening 35 as shown described herein.

In one example, the heel cage 36 may comprise a thermoplastic poly(ether) block copolymer elastomer, such as a polyether block amide, which may be PEBAX® available from Arkema, Inc. in King of Prussia, Pa. USA. Another example material that may be used for the heel cage 36 is a fiberglass reinforced polyamide. An example fiberglass reinforced polyamide is RISLAN® BZM 7 0 TL available from Arkema, Inc. in King of Prussia, Pa. USA. Such a fiberglass reinforced polyamide may have a density of 1.07 grams per cubic centimeter under ISO 1183 test method, an instantaneous hardness of 75 on a Shore D scale under ISO 868 test method, a tensile modulus of 1800 MPa under ISO 527 test method (with samples conditioned 15 days at 23 degrees Celsius with 50% relative humidity), and a flexural modulus of 1500 MPa under ISO 178 test method (with samples conditioned 15 days at 23 degrees Celsius with 50% relative humidity).

The heel counter 38 may include multiple layers, such as a first layer 38A and a second layer 38B. The second layer 38B may be relatively more rigid than the first layer 38A, and may be taller than the first layer 38A so that the second layer 38B establishes the upper extent 40 of the heel counter 38. The second layer 38B may also be thicker than the first layer 38A, or may be both taller and thicker than the first layer 38A. For example, the second layer 38B may be at least twice as thick as the first layer 38A. In one example, the first layer 38A may be a thermoplastic, such as a thermoplastic compressed powder material. For example, the first layer 38A may be a thermoplastic compressed powder material available as RHENOPRINT® P357 available from Rhenoflex located in Ludwigshafen Germany. The first layer 38A may have a thickness T1 of 0.8 mm, or within 10 percent of 0.8 mm, with the thickness T1 being the dimension from an interior surface to an exterior surface of the first layer 38A moving in a direction outward from the foot-receiving cavity 26 (e.g., along a longitudinal midline of the article of footwear 10). The second layer 38B may be the same material as the first layer 38A, such as the thermoplastic compressed powder material available as RHENOPRINT® P357, and may gain its increased rigidity due to its greater thickness T2. For example, the second layer 38B may be RHENOPRINT® P357 having a thickness T2 of 1.8 mm, or within 10 percent of 1.8 mm.

Figure 5:
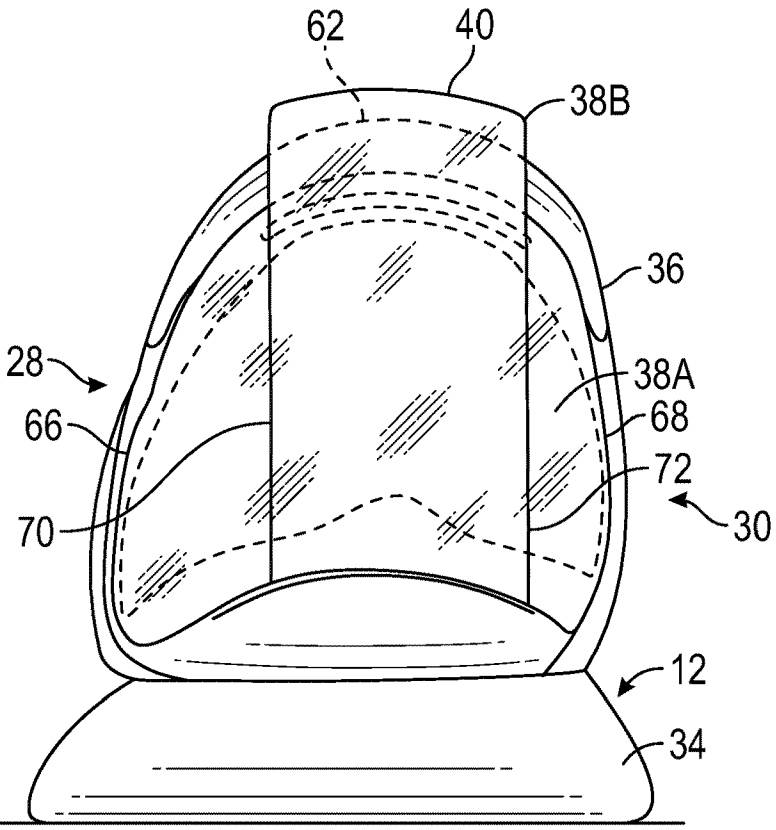
FIG. 5 is a front view of the article of footwear of FIG. 1 with the upper not shown.
Figure 4:
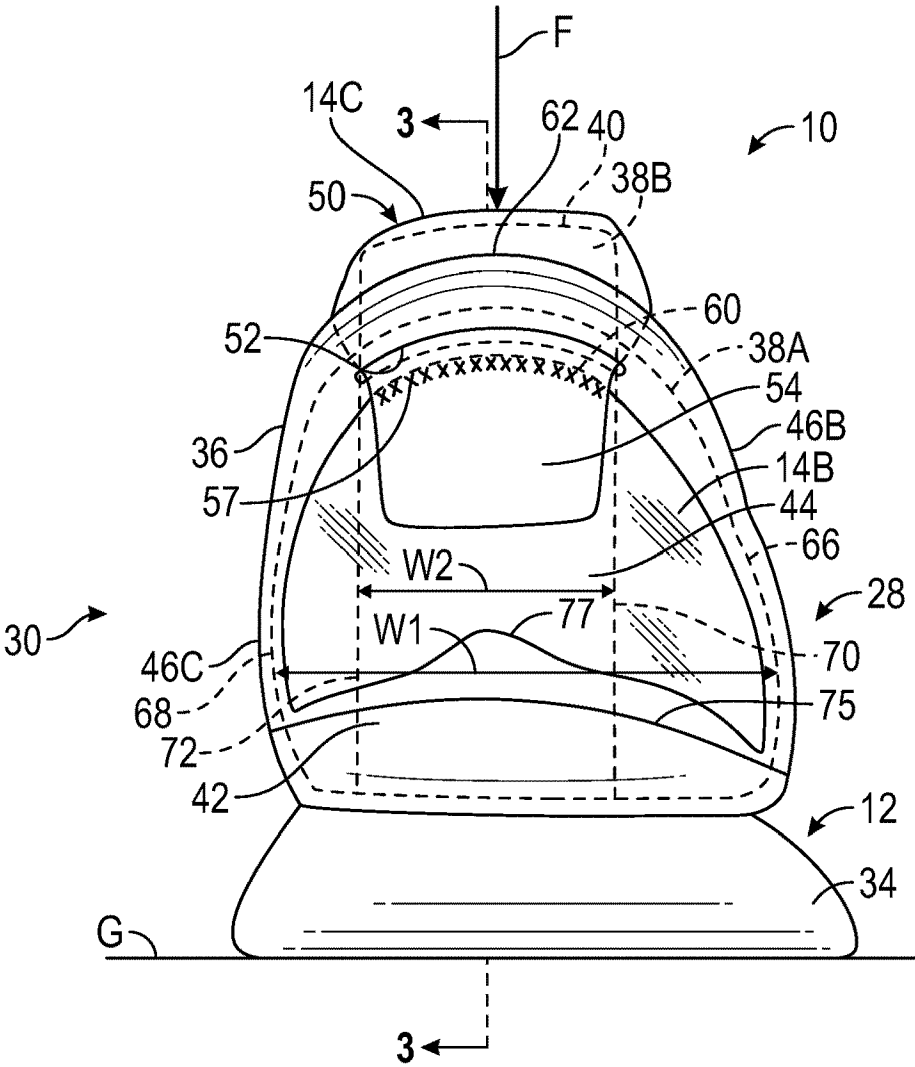
FIG. 4 is a rear view of the article of footwear of FIG. 1.

Because increased rigidity to inhibit collapse of the heel portion 19 of the upper 14 is needed mainly at the rear 44 of the heel portion 19 of the upper 14, in the heel region 18 of the article of footwear 10, overall weight and materials reduction may be achieved by focusing the relatively stiff second layer 38B at the rear 44 of the heel portion 19, with the less stiff first layer 38A extending further around the rear 44 of the upper 14 in the heel region 18 from the medial side 30 to the lateral side 28 than the second layer 38B, as best shown in and described with respect to FIGS. 4 and 5.

Figure 3:
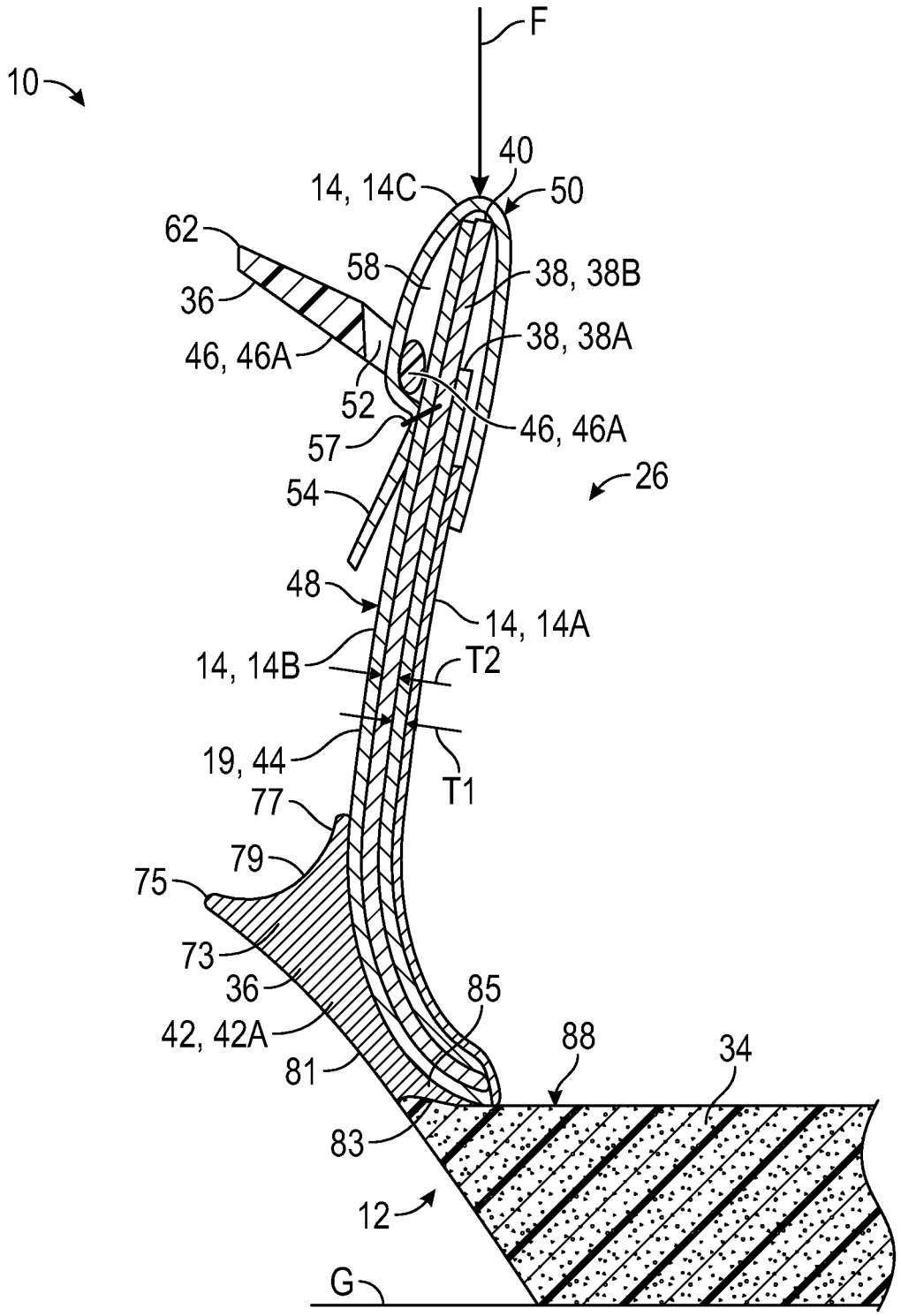
FIG. 3 is a fragmentary cross-sectional view of the article of footwear of FIG. 1 taken at lines 3-3 in FIG. 4, showing the heel counter included in the heel system.

With reference to FIG. 3, the heel counter 38 may be disposed inward of an exterior layer 14B of the upper 14. The exterior layer 14B is also referred to herein as an outer layer 14B of the upper 14. For example, the heel counter 38 may be disposed between the exterior layer 14B of the upper 14 and an interior layer 14A of the upper 14. The heel cage 36 may be disposed exterior to an exterior surface 48 of the exterior layer 14B of the upper 14. In such an implementation, the heel cage 36 is exposed at the exterior of the article of footwear 10, while the heel counter 38 is hidden from view between the exterior layer 14B and the interior layer 14A of the upper 14.

Because the second layer 38B of the relatively more rigid heel counter 38 extends to the upper extent 40 above the upper bar 46 of the heel cage 36, the heel counter 38 may inhibit collapse of the upper 14, and hence the heel cage 36, during foot entry. As shown in FIG. 3, the upper 14 extends over and covers the upper extent 40 of the heel counter 38. More specifically, the upper 14 includes a top layer 14C that wraps over the upper extent 40 of the heel counter 38 from the interior layer 14A to the exterior layer 14B. Stated differently, the top layer 14C is secured to the interior layer 14A (such as by stitching or adhesive) and to the exterior layer 14B. An exterior surface 50 of the top layer 14C of the upper 14 is disposed over the upper extent 40 of the heel counter 38. Accordingly, the exterior surface 50 is the surface contacted by the foot 24 (or by a sock worn on the foot 24) during foot entry into the foot-receiving cavity 26. The top layer 14C may be comprised of a material selected so that the exterior surface 50 has a coefficient of friction less than or equal to a predetermined coefficient of friction that allows easy gliding of the foot 24 into the foot-receiving cavity 26. For example, the top layer 14C may comprise leather at the exterior surface 50 disposed over the upper extent 40 of the heel counter 38. In one example, a natural leather, such as a natural full-grain leather, or a synthetic leather may be used. In another example, a coating may be applied to the top layer 14C, and the coating may establish the exterior surface 50 that has the coefficient of friction less than or equal to the predetermined coefficient of friction. The rigidity of the vertically-extended heel counter 38 in combination with the low coefficient of friction of the exterior surface 50 enable the top layer 14C and the heel counter 38 to together function similar to an integral shoe horn in the article of footwear 10.

FIG. 3 shows that the center segment 46A of the upper bar 46 defines a slot 52 that extends through the center segment 46A. The upper 14 includes a tab 54 that extends through the slot 52. The tab 54 is an integral portion of the top layer 14C in the embodiment shown. In other embodiments, the tab 54 could be a portion of another layer of the upper 14, or could be a separate component secured to the top layer 14C. As shown, the tab 54 is secured to the exterior layer 14B at the exterior surface 48 of the upper 14 at the rear 44 of the heel portion 19 of the upper 14 in the heel region 18 of the footwear 10, such as by stitching 57. Although shown as stitched with a box stitch in FIG. 4, other types of stitches, or other modes of securing the tab 54 to the upper 14 may be utilized, such as by use of a rivet through the tab 54 and the exterior layer 14B, by adhesive, or otherwise. Alternatively, the tab 54 could be secured to the exterior layer 14B by heat bonding or otherwise, depending on the materials of the tab 54 and the exterior layer 14B. Because the top layer 14C is also secured to the interior layer 14A, the portion of the center segment 46A inward of the slot 52 is confined to a space 58 between the tab 54 and the exterior layer 14B. The upper 14 is thus operatively secured to the center segment 46A of the upper bar 46. By securing the upper 14 to the center segment 46A of the upper bar 46 via the tab 54, the resistance to compression during foot entry provided by the relatively stiff heel counter 38 may also inhibit movement of the upper bar 46 toward the base 42. Although the space 58 is shown as relatively large for clarity in the drawings, the tab 54 may be pulled taught through the slot 52 and the stitching 57 may be very close to the underside of the center segment 46A to minimize the ability of the center segment 46A to move relative to the upper 14. FIG. 4 shows the stitching 57 disposed directly under and along the underside of the center segment 46A in this manner. As best shown in FIG. 4, the slot 52 is curved to follow the curved lower edge 60 of the center segment 46A, allowing the stitching 57 to most closely track the center segment 46A to minimize the space 58 and inhibit movement of the center segment 46A relative to the upper 14 or the base 42. In the embodiment shown, the tab 54 is secured to the upper 14 by box stitching 57, immediately below the slot 52.

FIG. 4 shows the relative shapes and positions of the heel cage 36, the first layer 38A, and the second layer 38B of the heel counter 38. The exterior surface 50 of the top layer 14C is the highest extent of the footwear 10, presenting the exterior surface 50 as the initial contact surface for the entering foot 24 (foot 24 not shown in FIG. 4). The upper extent 40 of the heel counter 38, and more specifically the upper extent 40 of the relatively stiff second layer 38B of the heel counter 38, extends above an upper extent 62 of the heel cage 36 when the footwear 10 rests on a horizontal ground plane G. A foot 24 entering from above is thus likely to apply a downward force F on the second layer 38B of the heel counter 38 through the top layer 14C rather than directly on the heel cage 36. Even if the foot 24 were positioned to initially contact the heel cage 36, due to the placement of the stitching 57 through the tab 54 directly under the lower edge 60 of the center segment 46A, the downward force will be transmitted to the upper extent 40 of the second layer 38B through the top layer 14C that forms the tab 54, and the relatively stiff heel counter 38 will inhibit movement of the upper bar 46 and of the upper 14 toward the base 42. The predetermined rigidity of the heel counter 38 and the coefficient of friction of the exterior surface 50 of the top layer 14C of the upper 14 exposed over the upper extent 40 of the heel counter 38 may enable a foot 24 to slide into the foot-receiving cavity 26 without deformation of the heel cage 36 when the foot exerts a predetermined force F on the exterior surface 50 of the upper 14 exposed over the upper extent 40 of the heel counter 38.

FIGS. 1, 2, 4 and 5 also indicate that the first layer 38A extends further forward from the rear 44 of the footwear 10 along the lateral side 28 and the medial side 30. More specifically, a lateral edge 66 and a medial edge 68 generally follow a midline of the lateral side arm 46B and a midline of the medial side arm 46C of the upper bar 46 of the heel cage 36, respectively, establishing a width W1 of the first layer 38A in the transverse direction of the footwear 10 (e.g., the direction from the lateral side 28 to the medial side 30). In contrast, the width W2 of the second layer 38B in the transverse direction of the footwear 10 is much less than the width W1 of the first layer 38A, so that a lateral edge 70 and a medial edge 72 of the second layer 38B are disposed generally along the rear 44 of the footwear 10, further rearward and further transversely inward than the edges 66, 68 of the first layer 38A.

Referring again to FIG. 3, the center segment 42A of the base 42 has a rear protrusion 73 extending generally rearward to a ridge 75 that forms a tip. The base 42 also includes an upward extension 77 at the center segment 42A. The center segment 42A has a beveled shape with a concave upper bevel 79 that slopes forwardly and upwardly from the ridge 75 to the upward extension 77, and with a lower bevel 81 that slopes downwardly and forwardly from the ridge 75 to a bottom 83 of the base 42 at which the base 42 is mounted on and secured to the sole structure 12. For example, the base 22 has an inwardly-extending flange 85, also shown in FIG. 6, that extends continuously from the medial base arm 42C, around the center segment 42A to the lateral base arm 42B such that the flange 85 generally has a U-shape. In such embodiments, the sole layer 34 may have a recess in which the flange 85 nests. The heel cage 36 is secured to the sole layer 34 by securing the flange 85 to upper surface 88 of the sole layer 34 by thermal bonding, by adhesive, or otherwise. The base 42 underlies the upper bar 46 and is secured to the footwear upper 14 with the medial base arm 42C secured to the medial side 30 of the exterior layer 14B (see FIG. 2), the lateral base arm 42B secured to a lateral side 28 of the exterior layer 14B (see FIG. 1), and the center segment 42A secured to the rear 44 of the exterior layer 14B (see FIG. 3).

Figure 6:
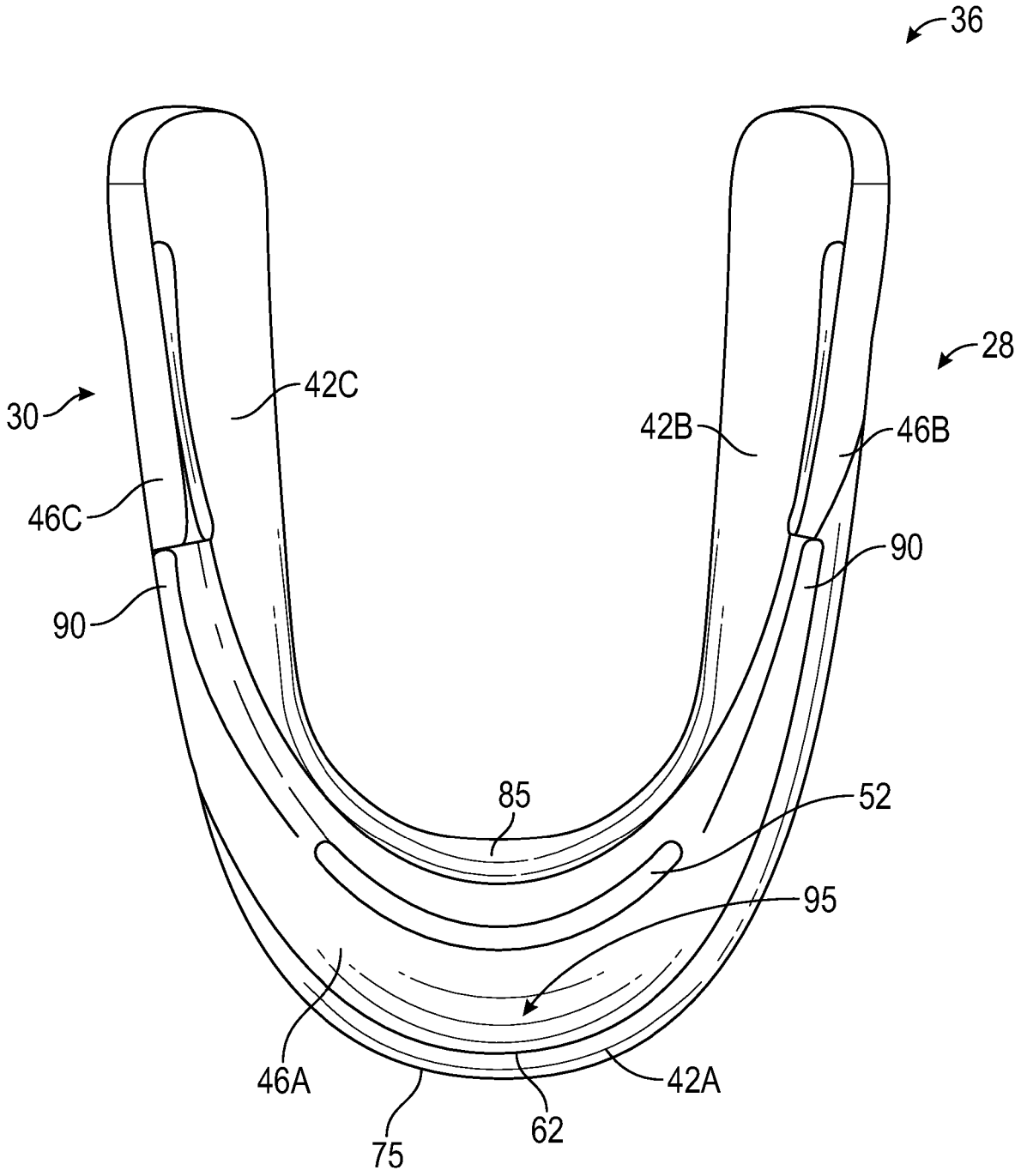
FIG. 6 is a plan view of the heel cage of the article of footwear of FIG. 1.

FIG. 6 illustrates that the lateral side arm 46B and the medial side arm 46C of the upper bar 46 of the heel cage 36 include a ledge 90 (also shown in FIGS. 1 and 2). The ledge 90 projects forwardly above a descending portion of a corresponding one of the lateral side arm 46B and medial side arm 46C, and may be referred to as a raised ledge. The raised ledge 90 extends from an upper surface 95 of the center segment 46A of the upper bar 46 partway down the lateral side arm 46B and medial side arm 46C. Because the second layer 38B does not extend laterally (e.g., transversely) to the ledge 90, and the first layer 38A ends at a midline of the upper bar 46, if the upper 14 is a flexible material, the portion of the upper 14 disposed above the ledge 90 may deform under the foot 24 during foot insertion, and the raised ledge 90 may provide a support structure for the foot 24 to rest against when inserting the foot 24 into the foot-receiving cavity 26. Due to the relatively tall second layer 38B of the heel counter 38 and the overlaying top layer 14C of the upper 14, the foot 24 should not contact the rear of the ledge 90 or the center segment 46A of the upper bar 46. However, should the foot 24 contact the portions of the raised ledge 90 above the lateral side arm 46B and medial side arm 46C, the upper bar 46, including the ledge 90, may comprise a material having certain properties, such as a relatively low coefficient of friction to encourage the foot 24 to slide downward and forward into the foot-receiving cavity 26. For example, the heel cage 36 or at least a coating on the heel cage 36 may comprise a polyether block amide as described herein, so that both bare skin of the foot 24 or any of various sock materials worn on the foot 24 may slide with greater ease downward and forward into the foot-receiving cavity 26 when sliding against the low friction top layer 14C and the low friction ledge 90.

Figure 7:
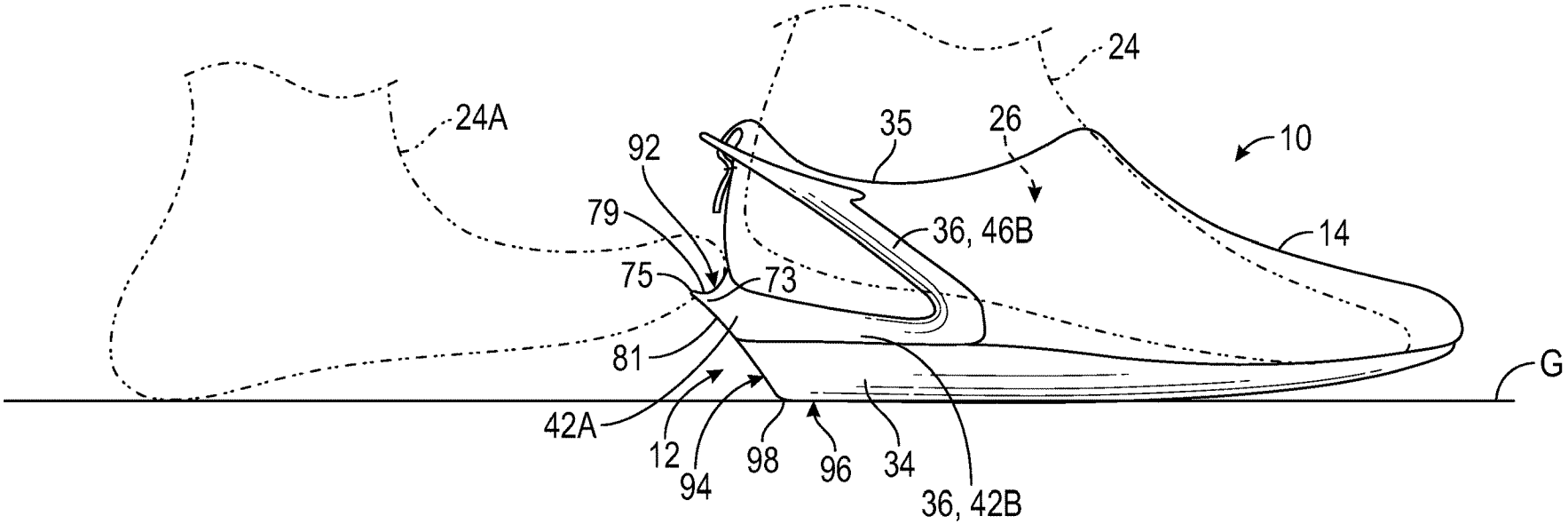
FIG. 7 is a lateral side view of the article of footwear of FIG. 1, with a left foot in phantom holding a rear protrusion of the heel cage, and a right foot in phantom withdrawing from the article of footwear.

FIG. 7 is a lateral side view of the article of footwear 10, with a left foot 24A in phantom resting on the rear protrusion 73 of the heel cage 36, and the right foot 24 in phantom withdrawing from the article of footwear. As best shown in FIG. 7, the wearer may rest their opposite foot 24A (e.g., the left foot as shown) on the concave upper bevel 79 to hold the footwear 10 in place as the foot 24 is removed from the foot-receiving cavity 26 of the upper 14 by withdrawing the foot 24 through the ankle opening 35. The ridge 75 is configured to protrude sufficiently far to enable the edge of the opposite foot 24A, or the toes of the opposite foot 24A to rest on the concave upper bevel 79. The outer surface 92 of the concave upper bevel 79 may provide more surface area in contact with the holding foot 24A than would the outer surface of a planar bevel, as portions of the surface of the holding foot 24A are also generally rounded and may better conform to the beveled outer surface 92 of the concave upper bevel 79.

As also shown in FIG. 7, the sole layer 34 has a rear surface 94 that slopes downwardly and forwardly from the lower bevel 81 at the same or substantially the same slope as the lower bevel 81. The continuous slope of the lower bevel 81 and the rear surface 94 moves the rearmost extent of the ground contact surface 96 of the sole layer 34 (shown resting on level ground plane G) slightly forward of the center segment 42A and the rear protrusion 73. This may encourage forces applied by the holding foot 24A on the concave upper bevel 79 to provide a torque about the back edge 98 of the sole layer 34 in contact with the ground plane G (e.g., a counterclockwise torque from the view in FIG. 7), counteracting the forces that the foot 24 being withdrawn may place on the footwear 10 when pressing upward against the upper 14 forward of the ankle opening 35 as the foot 24 is withdrawn.

Figure 8:
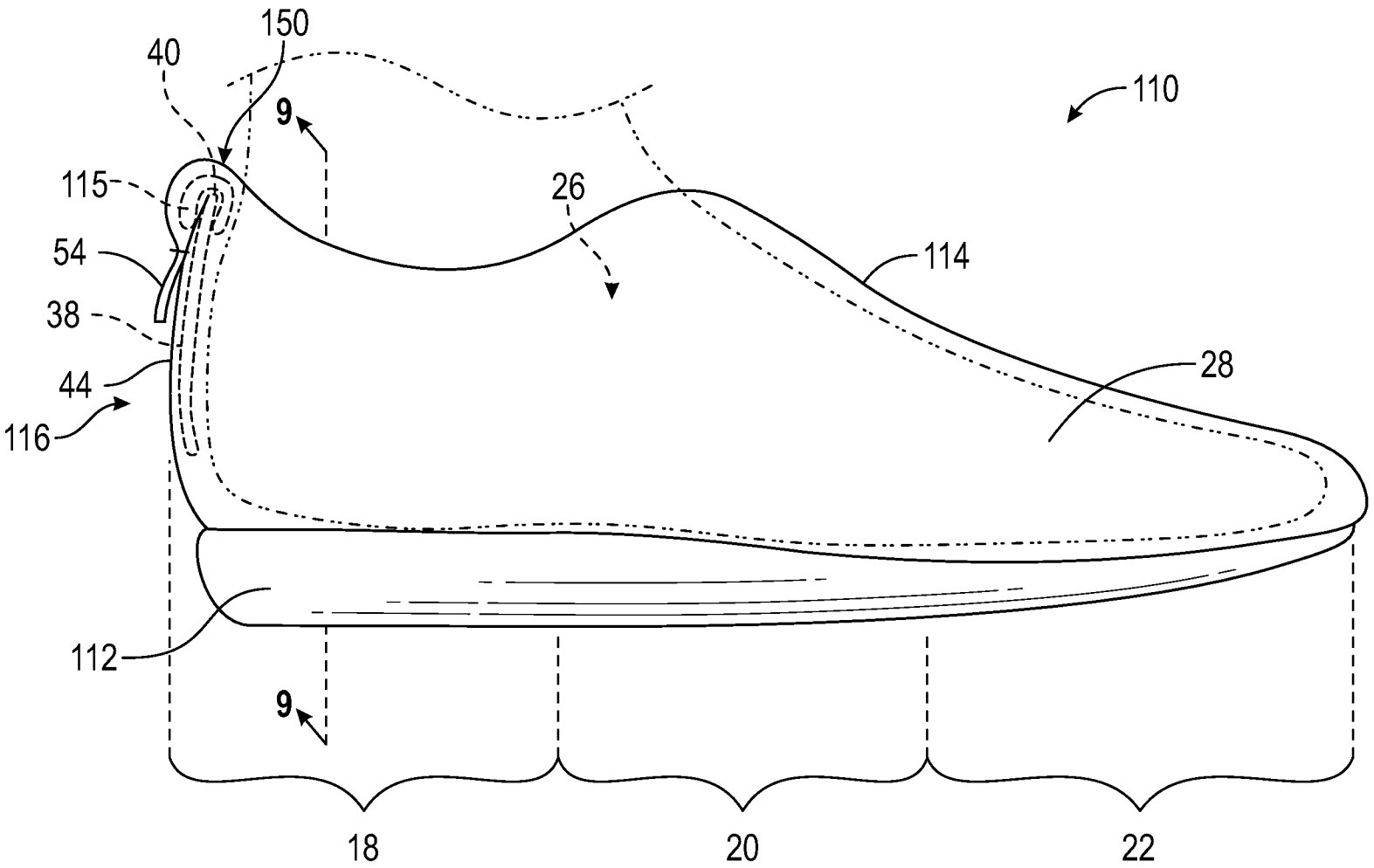
FIG. 8 is a lateral side view of an article of footwear having a heel system including a heel counter and a thickened upper above the heel counter.
Figure 9:
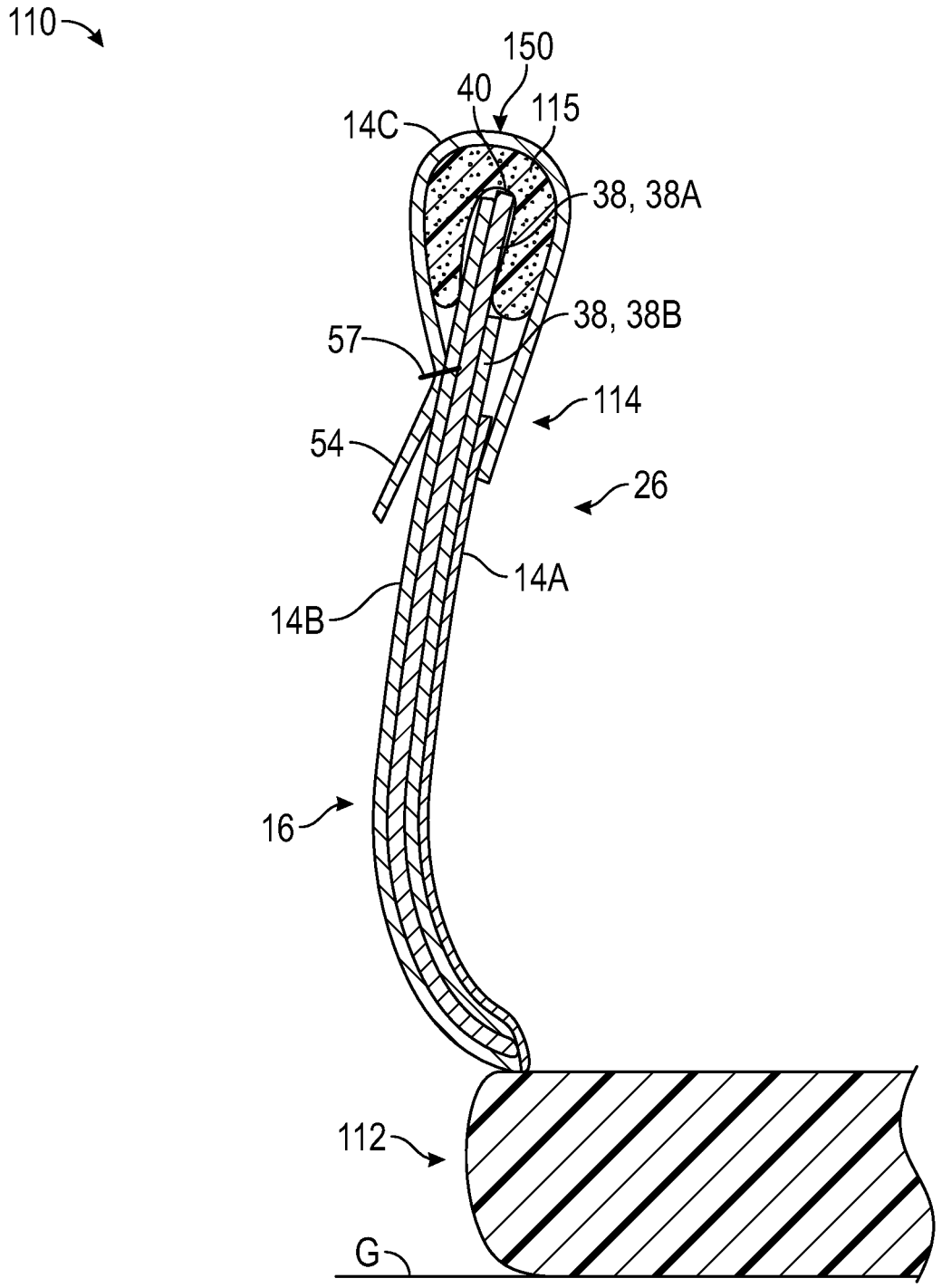
FIG. 9 is a cross-sectional view of the article of footwear of FIG. 8 taken along lines 9-9 in FIG. 8.

FIG. 8 is a lateral side view of an article of footwear 110 having an upper 114 and a sole structure 112. The sole structure 112 may be configured like sole structure 12 and composed with any of the materials described with respect to sole structure 12. The article of footwear 110 has a heel system 116 that includes the heel counter 38 with the first and second layers 38A, 38B as described with respect to the article of footwear 10. The heel system 116 does not include the heel cage 36. The upper 114 of the article of footwear 110 has many of the same features as upper 14, and some of these are labeled with like reference numbers. The tab 54 of the top layer 14C is simply folded over the heel counter 38 and secured to the rear 44 of the heel portion 19, but does not extend through a heel cage as the heel system 116 has no heel cage. The upper 114 is relatively thick over the upper extent 40 of the heel counter 38. For example, the upper 114 is thicker than the first layer 38A of the heel counter 38 at the upper extent 40, and is also thicker than the second layer 38B, and may be thicker than both the first layer 38A and the second layer 38B taken together. The upper 114 is also thicker than the upper 14 of the article of footwear 10 over the upper extent 40. The upper 114 may be thickened by disposing a compressible member 115, such as foam padding, between the top layer 14C and the heel counter 38 as best shown in FIG. 9. The upper 114 has an exterior surface 150 exposed over the upper extent 40 of the heel counter 38 and extending inward into the foot-receiving cavity 26. Because of the compressible member 115, the surface area of the exterior surface 150 that is exposed above the heel counter 38 and that may come into contact with the foot 24 upon foot entry is larger than the exterior surface 50 of the upper 14 above the upper extent 40 in the article of footwear 10 of FIG. 3. Alternatively, in some embodiments, no compressible member may be used, and the outer layer 14C alone causes an exterior surface of the upper 114 above the upper extent 40 to be larger than if only the interior layer 14A and exterior layer 14B of the upper 114 were attached together above the upper extent 40.

The exterior surface 150 of the outer layer 14C has a coefficient of friction less than or equal to a predetermined coefficient of friction. The relatively thick portion of the upper 114 establishing the exterior surface 150 above the upper extent 40 of the heel counter 38 spreads the force exerted by the bottom of the foot 24 over a larger surface area than would a thinner upper at this location, which may make the contact with the foot 24 with the upper 114 more comfortable. The relatively low coefficient of friction helps to counter the drag effect of the larger surface area of the exterior surface 150 in contact with the foot 24, making it easier for the foot 24 to slide. In some embodiments, an article of footwear may be configured like the article of footwear 10, but may include the compressible member 115 shown in the article of footwear 110 of FIG. 9. For example, an article of footwear may include a heel system 16 including both the heel counter 38 as described and the heel cage 36, and may also include the thickened upper above the heel counter 40 as established by the compressible member 115 expanding the contact surface area of the exterior surface 150.

Clause 1: An article of footwear comprising: an upper having a heel portion; a heel system including: a heel cage secured to the upper; and a heel counter extending along the rear of a heel portion to an upper extent of the heel counter above the heel cage.

Clause 2: The article of footwear of Clause 1, wherein the heel counter is relatively more rigid than the upper.

Clause 3: The article of footwear of Clause 2, wherein: the heel counter includes a first layer and a second layer; and the second layer is relatively more rigid than the first layer.

Clause 4: The article of footwear of Clause 3, wherein the second layer is taller than the first layer and establishes the upper extent of the heel counter.

Clause 5: The article of footwear of Clause 4, wherein the second layer is thicker than the first layer.

Clause 6: The article of footwear of Clause 5, wherein the second layer is at least twice as thick as the first layer.

Clause 7: The article of footwear of Clause 3, wherein the first layer extends further than the second layer around the rear of the heel portion from a medial side of the upper to the lateral side of the upper.

Clause 8: The article of footwear of Clause 1, wherein the heel counter is disposed inward of an exterior layer of the upper.

Clause 9: The article of footwear of Clause 8, wherein the heel counter is disposed between the exterior layer of the upper and an interior layer of the upper.

Clause 10: The article of footwear of Clause 8, wherein the heel cage is disposed exterior to an exterior surface of the exterior layer of the upper.

Clause 11: The article of footwear of Clause 1, wherein the heel counter comprises a thermoplastic compressed powder.

Clause 12: The article of footwear of Clause 1, wherein the heel cage comprises a thermoplastic poly(ether) block copolymer elastomer.

Clause 13: The article of footwear of Clause 1, wherein: the upper extends over and covers the upper extent of the heel counter.

Clause 14: The article of footwear of Clause 13, wherein an exterior surface of the upper disposed over the upper extent of the heel counter has a coefficient of friction less than or equal to a predetermined coefficient of friction.

Clause 15: The article of footwear of Clause 14, wherein the upper comprises leather at the exterior surface disposed over the upper extent of the heel counter.

Clause 16: The article of footwear of Clause 1, wherein: the heel cage includes a base and upper bar, the base extending around a rear of the heel portion from a medial side of the upper to a lateral side of the upper, and the upper bar extending around the rear of the heel portion above the base and connected to a forward medial portion of the base and to a forward lateral portion of the base, the upper bar spaced apart from the base at the rear of the heel portion; and the upper is operatively secured to a center segment of the upper bar.

Clause 17: The article of footwear of Clause 16, wherein: the center segment of the upper bar defines a slot; the upper includes a tab that extends through the slot; and the tab is secured to an exterior surface of the upper at the rear of the heel portion of the upper.

Clause 18: An article of footwear comprising: an upper having a heel portion and defining a foot-receiving cavity and an ankle opening communicating with the foot-receiving cavity; a heel system including: a heel cage having a base and an arched bar, the base extending around a rear of the heel portion from a medial side of the upper to a lateral side of the upper, and the arched bar extending around the rear of the heel portion above the base and connected to a forward medial portion of the base and to a forward lateral portion of the base, the arched bar spaced apart from the base at the rear of the heel portion and the heel cage surrounding the rear of the foot-receiving cavity below the ankle opening; and a heel counter extending along the rear of the heel portion to an upper extent above the arched bar; wherein the upper extends over the upper extent of the heel counter and has an exterior surface exposed over the upper extent of the heel counter and extending inward into the foot-receiving cavity from the ankle opening; and wherein the heel counter has at least a predetermined rigidity and the exterior surface of the upper exposed over the upper extent of the heel counter has a coefficient of friction less than or equal to a predetermined coefficient of friction.

Clause 19: The article of footwear of Clause 18, wherein the predetermined rigidity of the heel counter and the coefficient of friction of the exterior surface of the upper exposed over the upper extent of the heel counter enable a foot to slide into the foot-receiving cavity without deformation of the heel cage when the foot exerts a predetermined force on the exterior surface of the upper exposed over the upper extent of the heel counter.

Clause 20: The article of footwear of Clause 18, wherein: the heel cage comprises a thermoplastic poly(ether) block copolymer elastomer; the heel counter comprises a thermoplastic compressed powder; and the upper comprises leather at the exterior surface exposed over the upper extent of the heel counter and extending inward into the foot-receiving cavity from the ankle opening.

Clause 21: An article of footwear comprising: an upper having a heel portion and defining a foot-receiving cavity and an ankle opening communicating with the foot-receiving cavity; a heel system including: a heel counter extending along the heel portion to an upper extent; wherein the upper is thickened over the upper extent of the heel counter and has an exterior surface exposed over the upper extent of the heel counter and extending inward into the foot-receiving cavity from the ankle opening; and wherein the heel counter has at least a predetermined rigidity and the exterior surface of the upper exposed over the upper extent of the heel counter has a coefficient of friction less than or equal to a predetermined coefficient of friction.

To assist and clarify the description of various embodiments, various terms are defined herein. Unless otherwise indicated, the following definitions apply throughout this specification (including the claims). Additionally, all references referred to are incorporated herein in their entirety.

An "article of footwear", a "footwear article of manufacture", and "footwear" may be considered to be both a machine and a manufacture. Assembled, ready to wear footwear articles (e.g., shoes, sandals, boots, etc.), as well as discrete components of footwear articles (such as a midsole, an outsole, an upper component, etc.) prior to final assembly into ready to wear footwear articles, are considered and alternatively referred to herein in either the singular or plural as "article(s) of footwear".

"A", "an", "the", "at least one", and "one or more" are used interchangeably to indicate that at least one of the items is present. A plurality of such items may be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. As used in the description and the accompanying claims, a value is considered to be "approximately" equal to a stated value if it is neither more than 5 percent greater than nor more than 5 percent less than the stated value. In addition, a disclosure of a range is to be understood as specifically disclosing all values and further divided ranges within the range.

The terms "comprising", "including", and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

For consistency and convenience, directional adjectives may be employed throughout this detailed description corresponding to the illustrated embodiments. Those having ordinary skill in the art will recognize that terms such as "above", "below", "upward", "downward", "top", "bottom", etc., may be used descriptively relative to the figures, without representing limitations on the scope of the invention, as defined by the claims.

The term "longitudinal" refers to a direction extending a length of a component. For example, a longitudinal direction of a shoe extends between a forefoot region and a heel region of the shoe. The term "forward" or "anterior" is used to refer to the general direction from a heel region toward a forefoot region, and the term "rearward" or "posterior" is used to refer to the opposite direction, i.e., the direction from the forefoot region toward the heel region. In some cases, a component may be identified with a longitudinal axis as well as a forward and rearward longitudinal direction along that axis. The longitudinal direction or axis may also be referred to as an anterior-posterior direction or axis.

The term "transverse" refers to a direction extending a width of a component. For example, a transverse direction of a shoe extends between a lateral side and a medial side of the shoe. The transverse direction or axis may also be referred to as a lateral direction or axis or a mediolateral direction or axis.

The term "vertical" refers to a direction generally perpendicular to both the lateral and longitudinal directions. For example, in cases where a sole is planted flat on a ground surface, the vertical direction may extend from the ground surface upward. It will be understood that each of these directional adjectives may be applied to individual components of a sole. The term "upward" or "upwards" refers to the vertical direction pointing towards a top of the component, which may include an instep, a fastening region and/or a throat of an upper. The term "downward" or "downwards" refers to the vertical direction pointing opposite the upwards direction, toward the bottom of a component and may generally point towards the bottom of a sole structure of an article of footwear.

The "interior" of an article of footwear, such as a shoe, refers to portions at the space that is occupied by a wearer's foot when the shoe is worn. The "inner side" of a component refers to the side or surface of the component that is (or will be) oriented toward the interior of the component or article of footwear in an assembled article of footwear. The "outer side" or "exterior" of a component refers to the side or surface of the component that is (or will be) oriented away from the interior of the shoe in an assembled shoe. In some cases, other components may be between the inner side of a component and the interior in the assembled article of footwear. Similarly, other components may be between an outer side of a component and the space external to the assembled article of footwear. Further, the terms "inward" and "inwardly" refer to the direction toward the interior of the component or article of footwear, such as a shoe, and the terms "outward" and "outwardly" refer to the direction toward the exterior of the component or article of footwear, such as the shoe. In addition, the term "proximal" refers to a direction that is nearer a center of a footwear component, or is closer toward a foot when the foot is inserted in the article of footwear as it is worn by a user. Likewise, the term "distal" refers to a relative position that is further away from a center of the footwear component or is further from a foot when the foot is inserted in the article of footwear as it is worn by a user. Thus, the terms proximal and distal may be understood to provide generally opposing terms to describe relative spatial positions.

While various embodiments have been described, the description is intended to be exemplary, rather than limiting and it will be apparent to those of ordinary skill in the art that many more embodiments and implementations are possible that are within the scope of the embodiments. Any feature of any embodiment may be used in combination with or substituted for any other feature or element in any other embodiment unless specifically restricted. Accordingly, the embodiments are not to be restricted except in light of the attached claims and their equivalents. Also, various modifications and changes may be made within the scope of the attached claims.

While several modes for carrying out the many aspects of the present teachings have been described in detail, those familiar with the art to which these teachings relate will recognize various alternative aspects for practicing the present teachings that are within the scope of the appended claims. It is intended that all matter contained in the above description or shown in the accompanying drawings shall be interpreted as illustrative and exemplary of the entire range of alternative embodiments that an ordinarily skilled artisan would recognize as implied by, structurally and/or functionally equivalent to, or otherwise rendered obvious based upon the included content, and not as limited solely to those explicitly depicted and/or described embodiments.

What is claimed is:

1. An article of footwear comprising:

an upper having a heel portion;

a heel system including:

a heel cage secured to the upper; and a heel counter extending along a rear of the heel portion, and the heel counter having an upper extent above the heel cage;

wherein the heel counter includes a first layer and a second layer;

wherein the second layer is relatively more rigid than the first layer; and wherein the second layer is taller than the first layer and establishes the upper extent of the heel counter.

2. The article of footwear of claim 1, wherein the heel counter is relatively more rigid than the upper.

3. The article of footwear of claim 1, wherein the second layer is thicker than the first layer.

4. The article of footwear of claim 3, wherein the second layer is at least twice as thick as the first layer.

5. The article of footwear of claim 1, wherein the first layer extends further than the second layer around the rear of the heel portion from a medial side of the upper to a lateral side of the upper.

6. The article of footwear of claim 1, wherein the heel counter is disposed inward of an exterior layer of the upper.

7. The article of footwear of claim 6, wherein the heel counter is disposed between the exterior layer of the upper and an interior layer of the upper.

8. The article of footwear of claim 6, wherein the heel cage is disposed exterior to an exterior surface of the exterior layer of the upper.

9. The article of footwear of claim 1, wherein the heel counter comprises a thermoplastic compressed powder.

10. The article of footwear of claim 1, wherein the heel cage comprises a thermoplastic poly(ether) block copolymer elastomer.

11. The article of footwear of claim 1, wherein:

the upper extends over and covers the upper extent of the heel counter.

12. The article of footwear of claim 11, wherein an exterior surface of the upper disposed over the upper extent of the heel counter comprises leather.

13. The article of footwear of claim 1, wherein:

the heel cage includes a base and upper bar, the base extending around a rear of the heel portion from a medial side of the upper to a lateral side of the upper, and the upper bar extending around the rear of the heel portion above the base and connected to a forward medial portion of the base and to a forward lateral portion of the base, the upper bar spaced apart from the base at the rear of the heel portion; and the upper is operatively secured to a center segment of the upper bar.

14. The article of footwear of claim 13, wherein:

the center segment of the upper bar defines a slot;

the upper includes a tab that extends through the slot; and the tab is secured to an exterior surface of the upper at the rear of the heel portion of the upper.

15. An article of footwear comprising:

an upper having a heel portion and defining a foot-receiving cavity and an ankle opening communicating with the foot-receiving cavity;

a heel system including:

a heel cage having a base and an arched bar, the base extending around a rear of the heel portion from a medial side of the upper to a lateral side of the upper, and the arched bar extending around the rear of the heel portion above the base and connected to a forward medial portion of the base and to a forward lateral portion of the base, the arched bar spaced apart from the base at the rear of the heel portion and the heel cage surrounding the rear of the foot-receiving cavity below the ankle opening; and a heel counter extending along the rear of the heel portion, and the heel counter having an upper extent above the arched bar;

wherein the upper extends over the upper extent of the heel counter and has an exterior surface exposed over the upper extent of the heel counter and extending inward into the foot-receiving cavity from the ankle opening.

16. The article of footwear of claim 15, wherein:

the heel cage comprises a thermoplastic poly(ether) block copolymer elastomer;

the heel counter comprises a thermoplastic compressed powder; and the upper comprises leather at the exterior surface exposed over the upper extent of the heel counter and extending inward into the foot-receiving cavity from the ankle opening.

17. The article of footwear of claim 15, wherein the heel counter includes a first layer and a second layer;

wherein the second layer is relatively more rigid than the first layer; and wherein the second layer is taller than the first layer and establishes the upper extent of the heel counter.

18. The article of footwear of claim 15, wherein the heel counter includes a first layer and a second layer; and wherein the first layer extends further than the second layer around the rear of the heel portion from a medial side of the upper to a lateral side of the upper.

19. An article of footwear comprising:

an upper having a heel portion;

a heel system including:

a heel cage secured to the upper; and a heel counter extending along a rear of the heel portion, and the heel counter having an upper extent above the heel cage;

wherein the heel counter includes a first layer and a second layer;

wherein the second layer is relatively more rigid than the first layer and is taller than the first layer;

wherein the heel counter is disposed inward of an exterior layer of the upper; and wherein the first layer extends further than the second layer around the rear of the heel portion from a medial side of the upper to a lateral side of the upper.

* * * * *